US008082630B2

(12) United States Patent
Sprague et al.

(10) Patent No.: US 8,082,630 B2
(45) Date of Patent: Dec. 27, 2011

(54) DOOR HINGE

(75) Inventors: Glenn R. Sprague, Brighton, MI (US); Keith R. Sprague, Brighton, MI (US)

(73) Assignee: Claudio R. Ballard, Fort Lauderdale, FL (US)

( * ) Notice: Subject to any disclaimer, the term of this patent is extended or adjusted under 35 U.S.C. 154(b) by 394 days.

(21) Appl. No.: 12/395,646

(22) Filed: Feb. 28, 2009

(65) Prior Publication Data

US 2009/0271949 A1 Nov. 5, 2009

Related U.S. Application Data

(60) Provisional application No. 61/034,267, filed on Mar. 6, 2008.

(51) Int. Cl.
*E05D 15/00* (2006.01)

(52) U.S. Cl. ..... 16/369; 16/370; 296/146.12

(58) Field of Classification Search ..... 16/366, 16/368–370; 296/146.11, 146.12
See application file for complete search history.

(56) References Cited

U.S. PATENT DOCUMENTS 4,236,274 A 12/1980 Omote et al.
6,942,277 B2 * 9/2005 Rangnekar et al. ..... 296/146.11
7,350,273 B1 * 4/2008 Skipper ..... 16/366
7,636,985 B2 * 12/2009 Greenbank ..... 16/389
2002/0073507 A1 6/2002 Presley
2008/0222844 A1 9/2008 Broadhead et al.
2010/0301631 A1 * 12/2010 Scott et al. ..... 296/146.12

FOREIGN PATENT DOCUMENTS

GB 462033 A 3/1937
GB 2203483 A 10/1988

OTHER PUBLICATIONS

PCT: International Search Report of PCT/US09/35625 (related application); May 25, 2009; 4 pgs.
PCT: Written Opinion of the International Searching Authority of PCT/US09/35625 (related application); May 25, 2009; 6 pgs.

* cited by examiner

*Primary Examiner* — William L. Miller
(74) *Attorney, Agent, or Firm* — Howison & Arnott, L.L.P.

(57) ABSTRACT

A vehicle door hinge includes a base, a main link having first and second arms, a first end of the main link being pivotally mounted to the base at a first pivot, a drive link pivotally connected to an end of a control link, the drive link passing through a slot in the main link, a mounting plate having open ended slots opening at a first end of the plate, at least one closed end slot wherein an end of the drive link is pivotally secured in one of the open ended slots, an idle link pivotally secured in a closed end slot of the main link and an open ended slot of the door mounting plate, a kicker link having a first end thereof pivotally secured in the open ended slot of the main link and a second end pivotally secured in a closed end slot of the door mounting plate wherein the kicker link is longer than the idle link.

20 Claims, 6 Drawing Sheets

DOOR HINGE

CROSS-REFERENCE TO RELATED APPLICATIONS

This application claims the benefit of U.S. Provisional Application for Patent Ser. No. 61/034,267, filed Mar. 6, 2008, and entitled DOOR HINGE, the specification of which is incorporated herein in its entirety by reference.

TECHNICAL FIELD

The following disclosure relates to a single point door hinge adapted for use on vehicles, in particular open cockpit two seat roadster type automobiles.

BACKGROUND

Automobile and truck doors are typically relatively heavy, constructed from sheet metal, fiberglass and plastic components fitted over the door frame. Window glass and other components such as power window drive motors can add to the weight of a vehicle door. Due to weight of such vehicle doors, the doors are typically mounted on a post or pillar at the front of the door opening with a pair of hinges. However, such dual point mounting is not desirable for every vehicle. For example, in the case of smaller, roadster-type vehicles it may be desirable to utilize a single point hinge to mount the vehicle doors due to space constraints and design considerations. In the case of such vehicles, it may also be desirable to utilize a hinge design that allows the vehicle door to be rotated further open than conventional hinge designs permit to facilitate entry and exit from the vehicle.

A vehicle door such as an automobile door may be opened and closed tens of thousands of times during the life of the vehicle. Often, the vehicle operator may lean on the door when it is in an open position and pull on the door when entering or exiting the vehicle. Consequently, over time, wear and strain on the door hinges may result in the door sagging. When this occurs, the door latch components may not be in proper alignment when the door is closed and the operator may have difficulty closing the door. Thus, there exists a need for a single point door hinge that is durable and adaptable for use on a roadster type vehicle.

SUMMARY

The present disclosure, in one aspect thereof, provides a single point vehicle door hinge. The hinge including a base having top and bottom walls, an open side and first and second pivot attachments. A J-shaped main link has first and second ends, a bend with an internal angle less than ninety degrees with first and second arms extending from the bend. The first end of the main link is pivotally mounted to the base at the first pivot such that the main link may move between the bottom and top walls and through the open side when the main link is pivoted around the first pivot attachment. The main link has a first closed end slot that is disposed midway along the height of the main link that extends through the bend, a pair of second closed end slots spaced above and below the first closed end slot and a pair of open ended slots that open at the second end of the link. A control link has first and second ends, a first short leg, a bend and a second long leg. The control link is pivotally mounted to the base at a first end thereof. An S-shaped drive link has first and second ends with the first end pivotally connected to the second end of the control link. The drive link passes through the first closed end slot of the main link and is pivotally secured therein. A door mounting plate has first and second ends with three spaced apart open ended slots opening at the first end of the plate and a pair of closed end slots formed between the open ended slots and the second end of the door mounting plate wherein the second end of the drive link is pivotally secured in a center one of the open ended slots.

A pair of idle links having first ends are pivotally secured in the second closed end slots of the main link. The second ends thereof are pivotally secured in upper and lower ones of the open ended slots of the door mounting plate. A pair of kicker links having first ends are pivotally secured in the open ended slots of the main link. The second ends are pivotally secured in the closed end slots of the door mounting plate wherein the kicker links are longer than the idle links. The control link forces the drive link to pivot in the main link when the hinge is moved from a closed to an open position with the idle links and the kicker links pivoting to move the door mounting plate outward, away from the base and rearward from the base as the hinge is moved from a closed to an open position.

BRIEF DESCRIPTION OF THE DRAWINGS

For a more complete understanding, reference is now made to the following description taken in conjunction with the accompanying Drawings in which.

DETAILED DESCRIPTION

Figure 1:
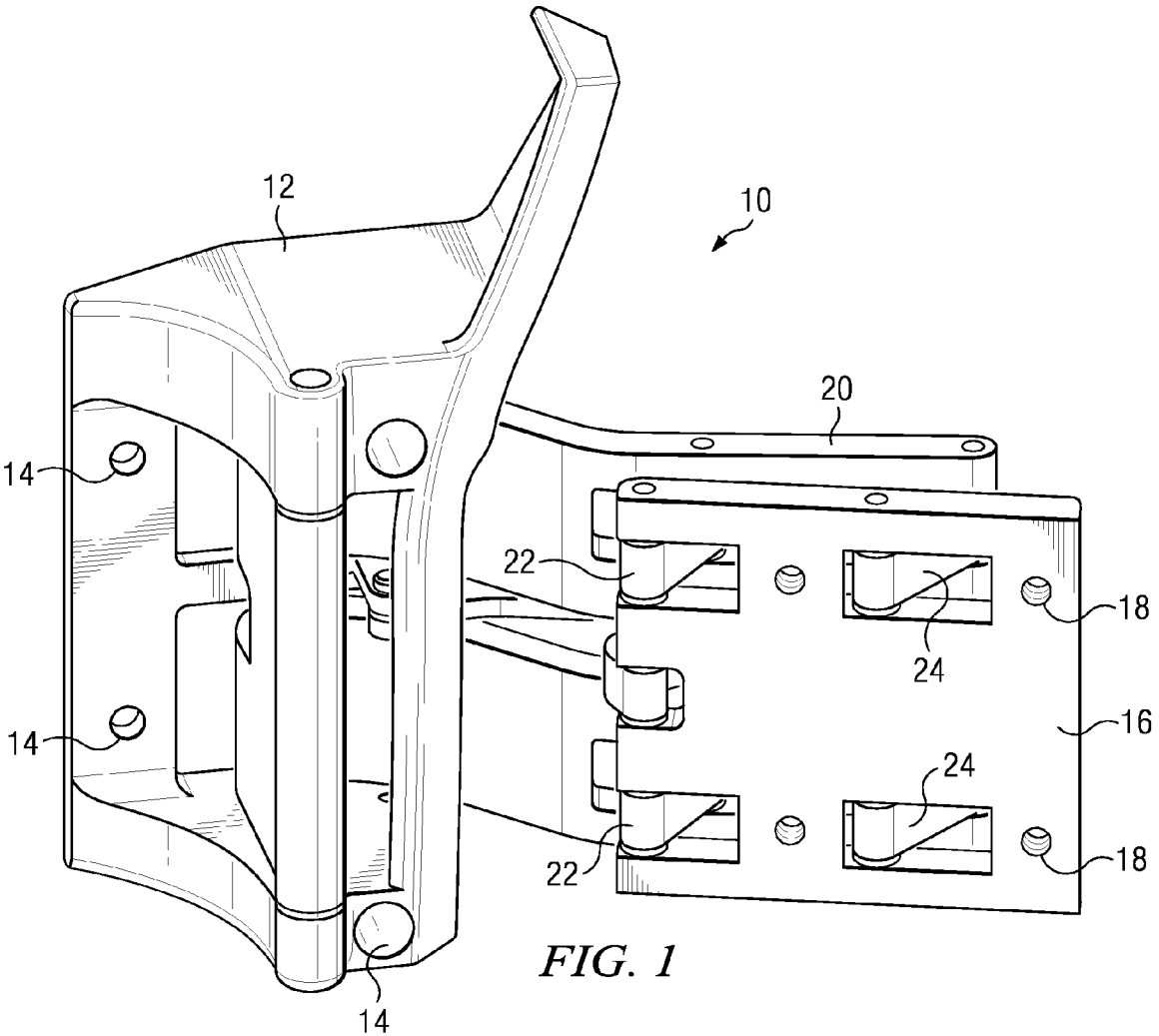
FIG. 1 is a perspective view of the single point vehicle door hinge.

Referring now to the drawings, wherein like reference numbers are used herein to designate like elements throughout, the various views and embodiments of a door hinge. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

FIG. 1 is a perspective view of a single point vehicle door hinge 10 according to the disclosure. Hinge 10 includes a base 12 having a plurality of bolt holes 14 in a generally rectangular pattern for mounting the hinge to the frame or body of a vehicle such as an automobile or truck. Hinge 10 is attached to a vehicle door with a door mounting plate 16 including a plurality of bolt holes 18, also arranged in a rectangular pattern, for attaching the hinge to a vehicle door. A main link 20 is pivotally mounted in base 12 and connects the base to mounting plate 16 with a plurality of idle links 22 and kicker links 24 as hereinafter described in greater detail.

Figure 2:
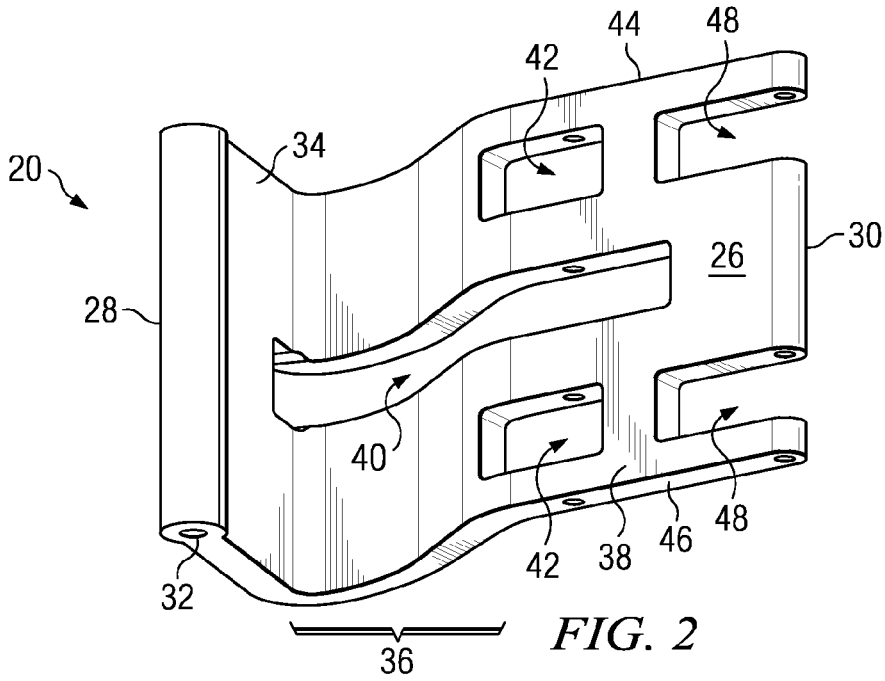
FIG. 2 is a perspective view of a main link of a vehicle door hinge of FIG. 1.

FIG. 2 is a perspective view of main link 20 of vehicle door hinge 10. Main link 20 comprises a plate 26 having a generally "J" shaped longitudinal profile with a first and second ends 28, 30. As illustrated first end 28 comprises a cylinder formed along the width of main link 20 having a diameter greater than the thickness of the remainder of main link 20 with transverse bores 32 (one shown) formed in the ends of the cylinder. A first arm or straight section 34 of main link 20 extends from first end 28 to a bend or elbow 36 having an internal angle less than ninety degrees. A second straight section or arm 38 of main link 20, having a length greater than first section 34 extends from elbow 36 to second end 30 of the main link.

Referring still to FIG. 2, a first, closed slot 40 extends along the length of main link 20 from first arm 34, through elbow 36 and into second arm 38. As illustrated, slot 40 is positioned midway along the height of main link 20. A pair of second closed end slots 42 extend along the length of main link 20 parallel to first slot 40 and midway between slot 40 and top and bottom walls 44, 46 of main link 20. Closed end slots 42 are configured to receive ends of idle links 22 therein. A set of open ended slots 48, configured to receive ends of kicker links 24 therein, extend from second end 30 of main link 20 toward second closed end slots 42. Open ended slots 48 are formed parallel to first closed end slot 40 and midway between slot 40 and top and bottom walls 44, 46 of main link 20.

Figure 3:
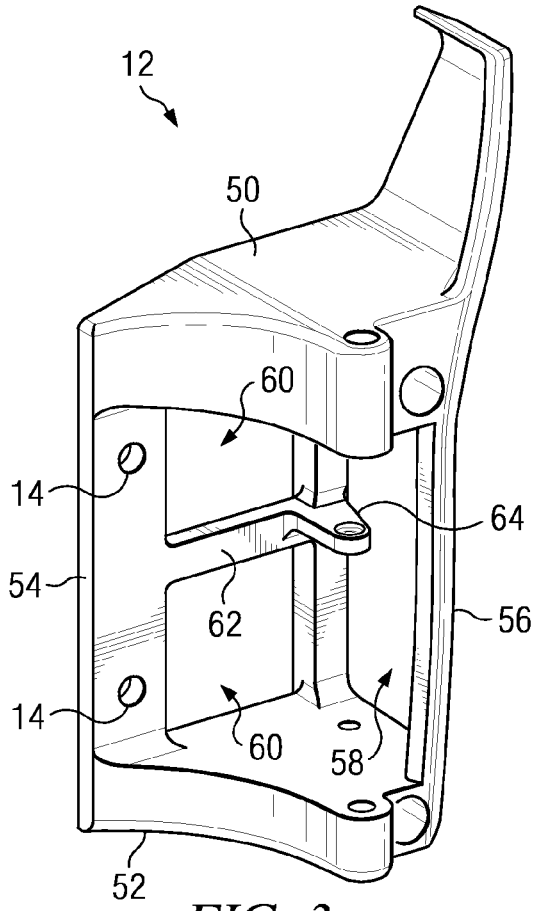
FIG. 3 is perspective view of the base of the single point vehicle door hinge of FIG. 1.
Figure 5:
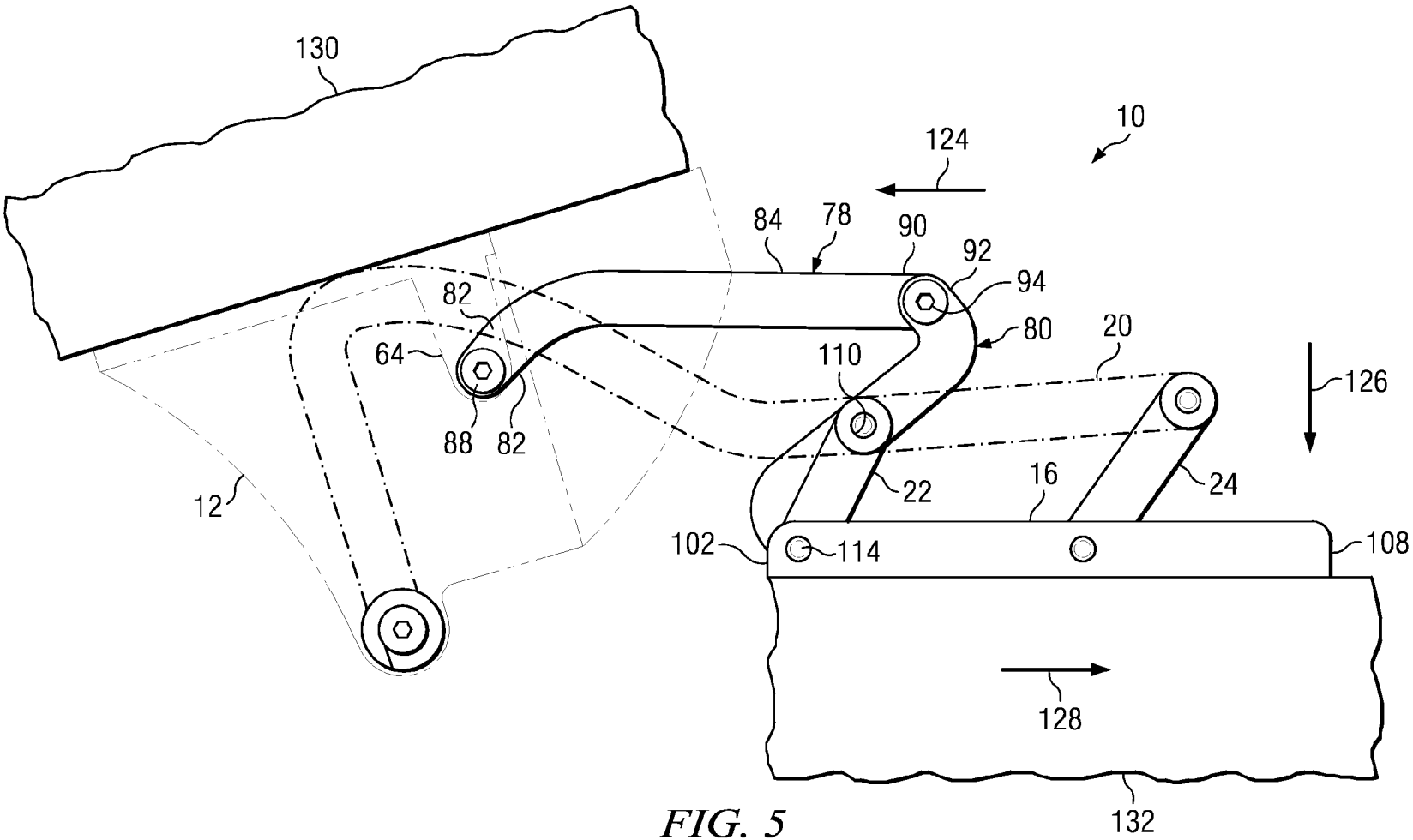
FIG. 5 is a top view of the vehicle door hinge of FIG. 1 with the base and main link show in phantom.

FIG. 3 is a perspective view of base 12 of the single point vehicle door hinge of FIG. 1. Base 12 includes top and bottom walls 50, 52, a side wall 54 and post 56 extending between the top and bottom walls. Base 12 is formed with a first open side 58 between side wall 54 and post 56 for receiving main link 20 therethrough. A pair of rectangular openings 60 formed in sidewall 54 provide clearance for elbows 36 as main link 20 pivots in base 12. Openings 60 are separated by a cross-member 62 having a width less than the width of closed slot 40 of main link 20 such that the cross-member extends into the closed end slot when the main link is pivoted inside base 12 as shown in FIG. 5. A pivot bracket 64 extends inwardly from sidewall 54 adjacent open side 58 and midway between top and bottom walls 50, 52 of base 12.

Figure 4:
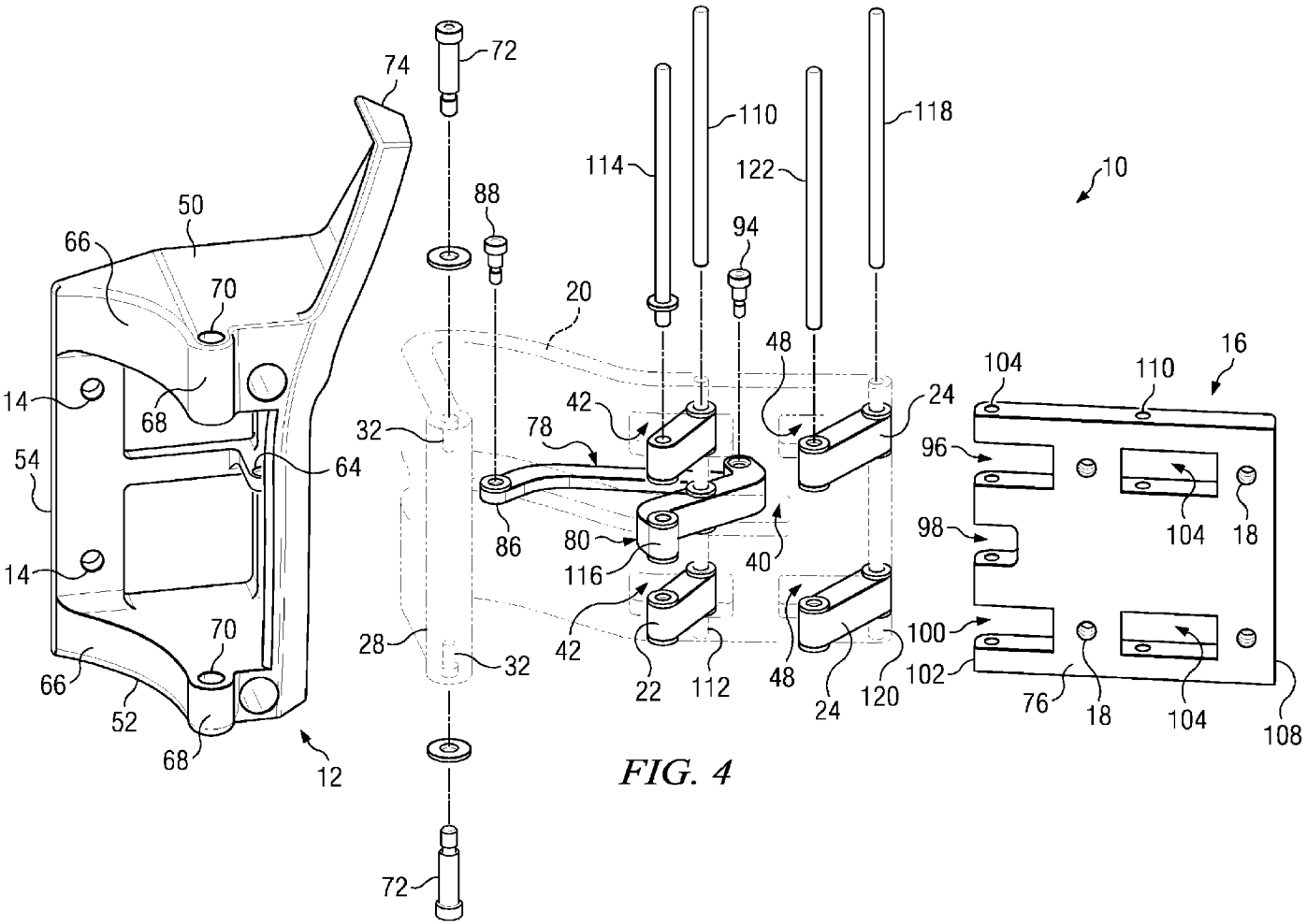
FIG. 4 is a partial exploded view of the vehicle door hinge of FIG. 1 with the main link shown in phantom.

FIG. 4 is a partial exploded view of the vehicle door hinge 10 of FIG. 1 with main link 20 shown in phantom. In the illustrated embodiment, top and bottom walls 50, 52 of base 12 have parallel, inwardly curved sides 66 that extend between sidewall 54 and semicylindrical mounting brackets 68. Holes 70 formed in mounting brackets 68 receive fasteners (e.g. pins or screws) 72 that extend through the mounting brackets and into bores 32 at the first end 28 of main link 20 to pivotally mount the main link in base 12. A brace 74 extending upwardly from top wall 50 is angled outwardly to match the geometry of the vehicle door frame on which hinge 10 is mounted and provide additional stability to the hinge.

Referring still to FIG. 4, door mounting plate 16 comprises a flat plate 76 having a plurality of bolt holes 18 for securing hinge to a vehicle door. Idle links 22 and kicker links 24 connect door mounting plate 16 to main link 20. As best illustrated in FIG. 5, a top view of the vehicle door hinge of FIG. 1 with base 12 and main line 20 shown in phantom, door mounting plate 16 is also connected to base 12 of hinge 10 through a control link 78 and an "S" shaped drive link 80 that passes though closed ended slot 40 of main link 20. Control link 78 has a first short leg 82 and a long second leg 84 extending at an angle from the first leg. Control link 78, drive link 80, idle links 22 and kicker links 24 control the movement of the door mounting plate 16 as hinge 10 is moved from closed to open positions.

A first end 86 of control link 78 is pivotally mounted to pivot bracket 64 (FIG. 3) of base 12 with a fastener 88. A second end 90 of control link 78 is pivotally attached to a first end 92 of "S" shaped drive link 80 with a fastener 94. Drive link 80 passes through closed end slot 40 of main link 20 and is pivotally attached to door mounting plate 16 at second end 116.

Referring again to FIG. 4, three spaced apart open ended slots 96, 98, and 100 are formed in a first end 102 of door mounting plate 16 with a transverse bore 104 extending through the door mounting plate and the open ended slots. Door mounting plate 16 also includes a pair of closed slots 106 formed parallel to and between open ended slots 66, 100 and the second end 108 of the mounting plate with a transverse bore 110 extending through the door mounting plate and the closed ended slots.

Referring still to FIG. 4, a first end of each of idle links 22 is received in one of closed end slots 42 of main link 20 and pivotally secured in the slot with a pivot pin 110 that passes through transverse bore 112 in the main link. Pivot pin 110 also mounts drive link 80 in closed end slot 40 of main link 20, passing through the control link midway along its length. The second ends of idle links 22 are received in open ended slots 96 and 100 of door mounting plate 16 and are pivotally secured in the open ended slots with a pivot pin 114 that passes through bore 104 in the mounting plate. Pivot pin 114 also secures a second end 116 of drive link 80 in open ended slot 98 of door mounting plate 16.

A first end of each of kicker links 24 is received in one of open end slots 48 of main link 20 and pivotally secured in the main link with a pivot pin 118 that passes through transverse bore 120. A second end of each of kicker links 24 is received in closed ended slots 104 of door mounting plate 16 and secured with a pivot pin 122 that passes through bore 110 of the mounting plate.

Referring again to FIG. 5, when a door 132 of a vehicle 130 employing hinge 10 is opened or closed, control link 78 which is fixed to base 12 at end 86 forces drive link 80 to pivot within main link 20 as the main link pivots relative to the base. When the door is opened drive link 80 pivots in the direction of arrow 124 forcing the door mounting plate 16 to move away from main link 20. This in turn forces the door to move in the directions indicated by arrows 126, 128, back and away from the vehicle. Thus, unlike a conventional hinge, hinge 10 not only pivots the vehicle door but also moves the vehicle door rearward and away from the vehicle such that the front edge of the door is moved to the rear and away from the vehicle. Also, as illustrated in FIG. 5, kicker links 24 are longer than idle links 22. The difference in length between idle links 22 and kicker links 24 causes the second end 108 of door mounting plate 16 to move a greater distance in the direction of arrow 126 than the first end 102 of the mounting plate. This in turn, causes the rear of the door to move even farther away from the vehicle, increasing the opening that the vehicle passenger has to enter and exit the vehicle.

Figure 6:
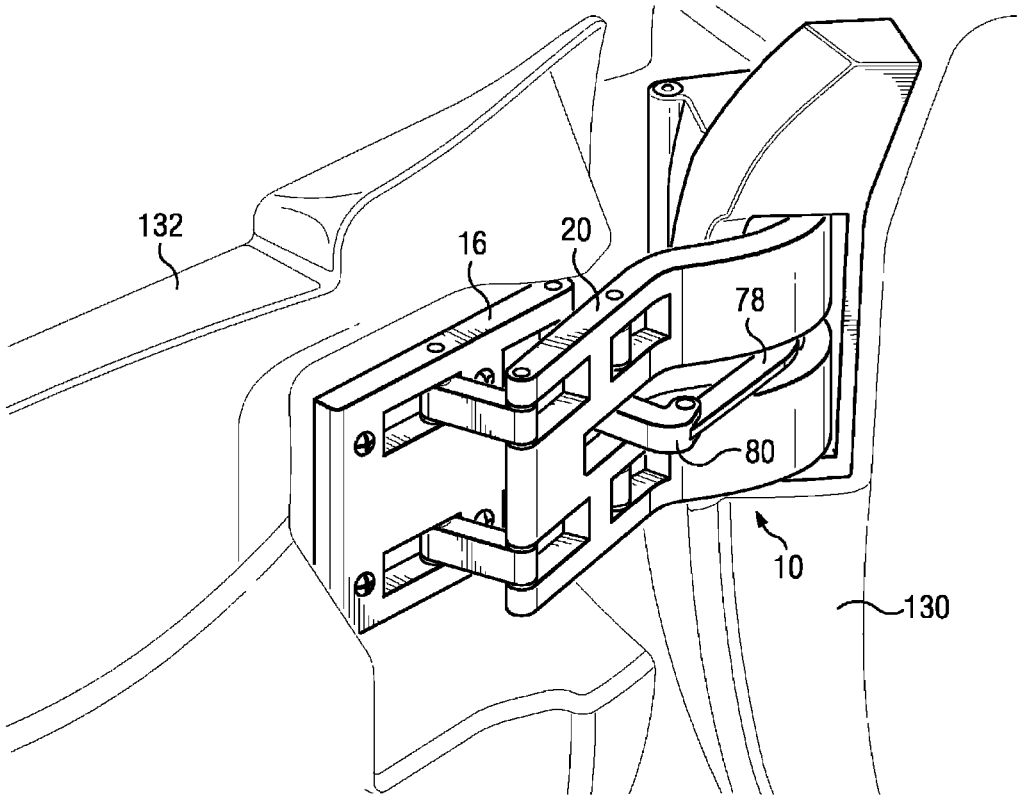
FIG. 6 illustrates the single point hinge of FIG. 1 mounted on a vehicle and vehicle door.
Figure 7:
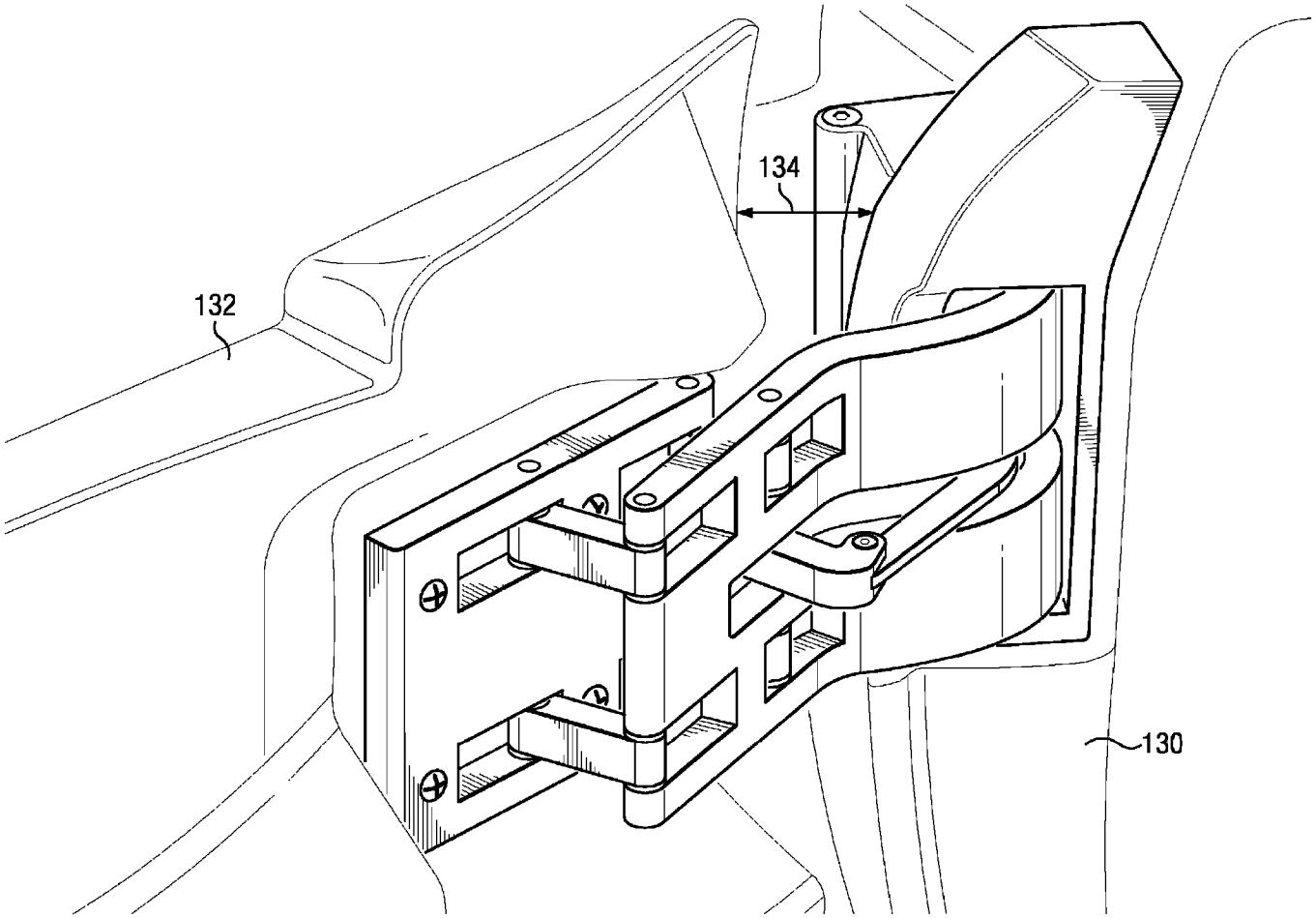
FIG. 7 illustrates an enlarged portion of FIG. 6.

FIG. 6 shows single point hinge 10 mounted on a vehicle 130 and vehicle door 132. FIG. 7 is an enlarge portion of FIG. 6, showing hinge 10 in greater detail. As shown, hinge 10 is formed from aluminum or steel with main link 20, door mounting plate 16, idle and kicker links 22, 24 each having a substantial thickness. The configuration of the open and closed ends slots describe above enables the use of such robust components without interference between the component as door 130 is opened and closed. While the embodiment illustrated in FIGS. 6 and 7 is formed from aluminum or a stainless steel, other steels could be used along with other high strength materials having comparable tensile, hardness and elongation properties.

FIG. 7 also illustrates the position of door 132 relative to vehicle 130 when the door is in the open position. As illustrated there is substantial gap 134 between the leading edge of door 132 and base 12 of hinge 10. The door has also been moved rearward relative to base 12 of hinge 10 due to the articulating action of the linkage of the hinge.

It will be appreciated by those skilled in the art having the benefit of this disclosure that this door hinge provides a single point door hinge adapted for use on vehicles, in particular open cockpit two seat roadster type automobiles. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A vehicle door hinge comprising:

a base including top and bottom walls, an open side and first and second pivot attachments, a main link having first and second ends, a bend, with first and second arms extending from the bend, the first end of the main link being pivotally mounted to the base at the first pivot attachment such that the main link moves between the bottom and top walls of the base and through the open side when the main link is pivoted around the first pivot attachment, the main link having a first closed end slot disposed midway along the height of the main link and extending through the bend, a pair of second closed end slots spaced above and below the first closed end slot and a pair of open ended slots that open at the second end of the link;

a control link having first and second ends, a first short leg, a bend and a second long leg, the control link pivotally mounted to the base at the first end;

a drive link having first and second ends with the first end pivotally connected to the second end of the control link, the drive link passing through the first closed end slot of the main link and being pivotally secured therein;

a door mounting plate having first and second ends with a plurality of spaced apart open ended slots formed therein and opening at the first end of the plate and at least one closed end slot formed between the open ended slots and the second end of the door mounting plate wherein the second end of the drive link is pivotally secured in a center one of the open ended slots;

at least one idle link having a first end thereof pivotally secured in a second closed end slot of the main link and a second end thereof pivotally secured in an open ended slot of the door mounting plate;

at least one of kicker link having a first end thereof pivotally secured in the open ended slot of the main link and a second end pivotally secured in a closed end slot of the door mounting plate wherein the kicker link is longer than the idle link; and wherein the control link forces the drive link to pivot in the main link when the hinge is moved from a closed to an open position with the at least one idle link and the at least one kicker link pivoting to move the door mounting plate outward away from the base and rearward from the base as the hinge is moved from the closed to the open position.

2. The vehicle door hinge of claim 1 wherein the main link is J-shaped with the bend having an internal angle less than ninety degrees.

3. The vehicle door hinge of claim 1 wherein the drive link is substantially S-shaped.

4. The vehicle door hinge of claim 1 wherein the main link comprises a plate having a generally "J" shaped longitudinal profile with the first and second ends, the first end comprising a cylinder formed along the width of main link.

5. The door hinge of claim 4 wherein the cylinder has a diameter greater than the thickness of the remainder of main link with transverse bores formed in the ends of the cylinder.

6. The vehicle door hinge of claim 5 wherein the first and second pivot attachments of the base comprise semicylindrical mounting brackets having holes formed therein.

7. The vehicle door hinge of claim 6 further comprising fasteners that extend through the holes in the mounting brackets and into the bores at the first end of the main link to pivotally mount the main link in the base.

8. The vehicle door hinge of claim 1 wherein the door mounting plate has three of the spaced apart open ended slots and a pair of the closed end slots.

9. The vehicle door hinge of claim 1 wherein a pair of the idle links having the first ends thereof are pivotally secured in the second closed end slots of the main link and the second ends thereof pivotally secured in upper and lower ones of the open ended slots of the door mounting plate.

10. The vehicle door hinge of claim 1 wherein a pair of the kicker links has the first end thereof pivotally secured in the open ended slot of the main link and the second end pivotally secured in the closed end slot of the door mounting plate wherein the kicker link is longer than the idle link.

11. A vehicle door hinge comprising:

a base including top and bottom walls, an open side and first and second pivot attachments, a J-shaped main link having first and second ends, a bend with an internal angle less than ninety degrees with first and second arms extending from the bend, the main link having a first closed end slot disposed midway along the height of the main link and extending through the bend, a pair of second closed end slots spaced above and below the first closed end slot and a pair of open ended slots that open at the second end of the link;

a control link having first and second ends, a first short leg, a bend and a second long leg, the control link pivotally mounted to the base at the first end;

an S-shaped drive link having first and second ends with the first end pivotally connected to the second end of the control link, the drive link passing through the first closed end slot of the main link and being pivotally secured therein;

a door mounting plate having first and second ends with three spaced apart open ended slots formed therein and opening at the first end of the plate and a pair of closed end slots formed between the open ended slots and the second end of the door mounting plate wherein the second end of the drive link is pivotally secured in a center one of the open ended slots;

a plurality of idle links having first ends thereof pivotally secured in the second closed end slots of the main link and second ends thereof pivotally secured in upper and lower ones of the open ended slots of the door mounting plate;

a plurality of kicker links having first ends thereof pivotally secured in the open ended slots of the main link and second ends pivotally secured in the closed end slots of the door mounting plate wherein the kicker links are longer than the idle links; and wherein the control link forces the drive link to pivot in the main link when the hinge is moved from a closed to an open position with the idle links and the kicker links pivoting to move the door mounting plate outward away from the base and rearward from the base as the hinge is moved from the closed to the open position.

12. The vehicle door hinge of claim 11 wherein the first end of the main link is pivotally mounted to the base at the first pivot attachment such that the main link moves between the bottom and top walls and through the open side when the main link is pivoted around the first pivot attachment.

13. The vehicle door hinge of claim 11 further comprising a pair of the idle links having the first ends thereof pivotally secured in the second closed end slots of the main link and the second ends thereof pivotally secured in upper and lower ones of the open ended slots of the door mounting plate.

14. The vehicle door hinge of claim 11 further comprising a pair of the kicker links having the first ends thereof pivotally secured in the open ended slots of the main link and the second ends pivotally secured in the closed end slots of the door mounting plate wherein the kicker links are longer than the idle links.

15. The vehicle door hinge of claim 11 wherein the hinge moves the vehicle door rearward and away from the vehicle as the hinge pivots such that the front edge of the door is moved to the rear and away from the vehicle.

16. The vehicle door hinge of claim 11 wherein the J-shaped main link comprises a plate having a generally "J" shaped longitudinal profile with the first and second ends, the first end comprising a cylinder formed along the width of main link and wherein the cylinder has a diameter greater than the thickness of the remainder of main link with transverse bores formed in the ends of the cylinder.

17. The vehicle door hinge of claim 16 wherein the first and second pivot attachments of the base comprise semicylindrical mounting brackets having holes formed therein.

18. The vehicle door hinge of claim 17 further comprising fasteners that extend through the holes in the mounting brackets and into the bores at the first end of the main link to pivotally mount the main link in the base.

19. A vehicle door hinge comprising:

a base including top and bottom walls, an open side and first and second pivot attachments, a generally J-shaped main link having first and second ends, a bend with an internal angle less than ninety degrees with first and second arms extending from the bend, the main link having a first closed end slot disposed midway along the height of the main link and extending through the bend, a pair of second closed end slots spaced above and below the first closed end slot and a pair of open ended slots that open at the second end of the link;

a control link having first and second ends, a first short leg, a bend and a second long leg, the control link pivotally mounted to the base at the first end;

an S-shaped drive link having first and second ends with the first end pivotally connected to the second end of the control link, the drive link passing through the first closed end slot of the main link and being pivotally secured therein;

a door mounting plate having first and second ends with a plurality of spaced apart open ended slots formed therein and opening at the first end of the plate and a plurality of closed end slots formed between the open ended slots and the second end of the door mounting plate wherein the second end of the drive link is pivotally secured in one of the open ended slots;

a plurality of idle links having first ends thereof pivotally secured in the second closed end slots of the main link and second ends thereof pivotally secured in upper and lower ones of the open ended slots of the door mounting plate;

a plurality of kicker links having first ends thereof pivotally secured in the open ended slots of the main link and second ends pivotally secured in the closed end slots of the door mounting plate wherein the kicker links are longer than the idle links; and wherein the control link forces the drive link to pivot in the main link when the hinge is moved from a closed to an open position with the idle links and the kicker links pivoting to move the door mounting plate outward away from the base and rearward from the base as the hinge is moved from the closed to the open position.

20. The vehicle door hinge of claim 19 wherein the door mounting plate has three of the spaced apart open ended slots and a pair of the closed end slots and wherein the second end of the drive link is pivotally secured in a center one of the open ended slots.

* * * * *